US006287397B1

(12) United States Patent
Hanamura et al.

(10) Patent No.: US 6,287,397 B1
(45) Date of Patent: Sep. 11, 2001

(54) HIGH STRENGTH PHOSPHORUS-CONTAINING STEEL AND METHOD FOR PRODUCING THE SAME

(75) Inventors: Toshihiro Hanamura; Hiroshi Nakajima; Shiro Torizuka; Kaneaki Tsuzaki; Kotobu Nagai, all of Ibaraki (JP)

(73) Assignees: Japan as represented by Director General of National Research Institute of Metals, Ibaraki; Japan Science & Technology Corporation, Saitama; Mitsubishi Heavy Industries. Ltd., Tokyo, all of (JP)

( * ) Notice: Subject to any disclaimer, the term of this patent is extended or adjusted under 35 U.S.C. 154(b) by 0 days.

(21) Appl. No.: 09/386,503

(22) Filed: Aug. 31, 1999

(30) Foreign Application Priority Data

Aug. 31, 1998 (JP) ..... 10-260957

(51) Int. Cl.[7] ..... C21D 8/00; C22C 38/00

(52) U.S. Cl. ..... 148/320; 148/579; 148/654; 420/87

(58) Field of Search ..... 420/87; 148/320, 148/579, 654

(56) References Cited

FOREIGN PATENT DOCUMENTS

409111396 * 4/1997 (JP) .
411100641 * 4/1999 (JP) .

* cited by examiner

*Primary Examiner*—Deborah Yee
(74) *Attorney, Agent, or Firm*—Wenderoth, Lind & Ponack, L.L.P.

(57) ABSTRACT

A high strength phosphorus-containing steel having fine texture free from the problem of embrittlement by positively using the presence of P, which is a carbon steel having an average ferritic grain diameter of 3 $\mu$m or less and containing from 0.04 to 0.1% by mass of P, wherein the volume fraction of P segregated in the grain boundary accounts for 0.3 or less in case the grain boundary is covered by a P layer 1 nm in thickness.

4 Claims, 3 Drawing Sheets

HIGH STRENGTH PHOSPHORUS-CONTAINING STEEL AND METHOD FOR PRODUCING THE SAME

BACKGROUND OF THE INVENTION

1. Field of the Invention

The present invention relates to a high strength phosphorus-containing steel and a method for producing the same. In further detail, it relates to a carbon steel improved in strength by finely reducing ferritic grains, and to a method for producing the same.

2. Description of the Related Art

Conventionally, much effort has been made to remove P (phosphorus) in a smelting process for low carbon steel because P is known to have negative effects in the low temperature toughness of the product. However, the fact that the presence of P is not allowed had made it difficult to simplify the conventional smelting process, and the presence of P has been an obstacle in the reuse of steel materials.

Practically, for instance, in case P is contained at an amount of 0.1% by mass, the ductile/brittle transition point is increased by 40 K. Thus, carbon steel had been suffering the problem of embrittlement due to the presence of P, and in conventional smelting processes, great effort was necessary for the removal of P.

Apart from the problems above, the present inventors have been studying finely reducing the size of ferritic grains with an aim to develop high strength steel materials. In due course, it has been found that the transition temperature is considerably lowered by finely reducing the size of ferritic grains. Accordingly, it has been presumed that the problem of the embrittlement due to the presence of P can be overcome by finely reducing the size of crystal grains.

However, it was still a problem how to finely reduce the size of ferritic grains while controlling the presence of P.

The invention of the present application has been made in the light of the aforementioned circumstances, and it provides a high strength steel by overcoming the limits of the related art technology, and yet, by positively using the presence of P.

SUMMARY OF THE INVENTION

According to a first aspect of the present invention, there is provided a high strength phosphorus-containing steel having fine texture, which is a carbon steel having an average ferritic grain diameter of 3 $\mu$m or less and containing from 0.04 to 0.1% by mass of P, wherein the volume fraction of P segregated in the grain boundary accounts for 0.3 or less in case the grain boundary is 1 nm in thickness.

Further, in accordance with a second aspect of the present invention, there is provided a high strength phosphorus-containing steel as above, wherein, the basic components thereof as expressed by chemical composition in % by mass are 0.3% or less of C, 0.5% or less of Si, 3.0% or less of Mn, 0.02% or less of S, 0.04 to 0.1% of P and Fe.

Further according to a third aspect of the present invention, there is provided a method for producing the steel above, comprising heating the steel to a temperature of Ac3 point or higher for austenization, applying an anvil compression processing for a draught of 50% or higher at a temperature of Ar3 point or higher, and cooling it thereafter.

DESCRIPTION OF THE PREFERRED EMBODIMENTS

Although the characteristics of the present invention is briefly described above, the embodiment of the present invention is described in further detail below.

The high strength phosphorus-containing steel having a fine texture according to the present invention is based on the following points.

(1) By finely reducing the size of the ferritic grains, the transition temperature is considerably lowered and the problem of embrittlement due to the presence of P is overcome.

(2) Phosphorus decreases the energy of layer stacking faults and increases the density of annealed twins.

(3) Phosphorus segregates in the interface between adjacent grains to lower the rate of grain growth in accordance with the dragging effect. Thus, it is effective for finely reducing the ferritic grains by phase transformation from being worked $\gamma$.

(4) Phosphorus is inexpensive, has excellent effect in reinforcing the product by forming a solid solution, and does not increase the value of Ceq.

Thus, as described above, the steel having the fine microstructure according to the present invention is realized by positively utilizing the characteristics of P to finely reduce the size of ferritic grains.

The carbon steel according to the present invention has requirements as follows:

<A> The ferritic grains have a mean diameter of 3 $\mu$m or less;

<B> The carbon steel contains from 0.04 to 0.1% by mass of P; and

<C> The volume fraction of P segregated in the grain boundaries account for 0.3 or less in case the grain boundary is 1 nm in thickness.

The requirements above are correlated with each other. In the present invention, the term "carbon steel" is defined as iron containing 1.0% by weight or less of carbon (C). The mean diameter of the ferritic grains according to <A> in the present invention is 3 $\mu$m or less, and the mean diameter in this case is calculated by multiplying the fraction of grains measured on the cross section photograph by means of section method by 1.128 (nominal ASTM grain diameter). The content of P according to <B> is defined in the range of from 0.04 to 0.1% by mass based on the range which does not induce low temperature embrittlement, because an addition of 0.1% by mass of P increases the Hv (Vickers' hardness) by 20 and an addition of 0.04% by means of P increases the Hv by 10. From the viewpoint that the fine reduction in diameter of ferritic grains lowers the ductile/brittle transition point and enables overcoming the embrittlement of the carbon steel due to P, and that a high strength carbon steel is thereby realized, the diameter of ferritic grains is set to 3 μm or less <A>. As a matter of course, the content of P defined above includes unavoidable impurities incorporated in the components of the starting material.

Figure 1:
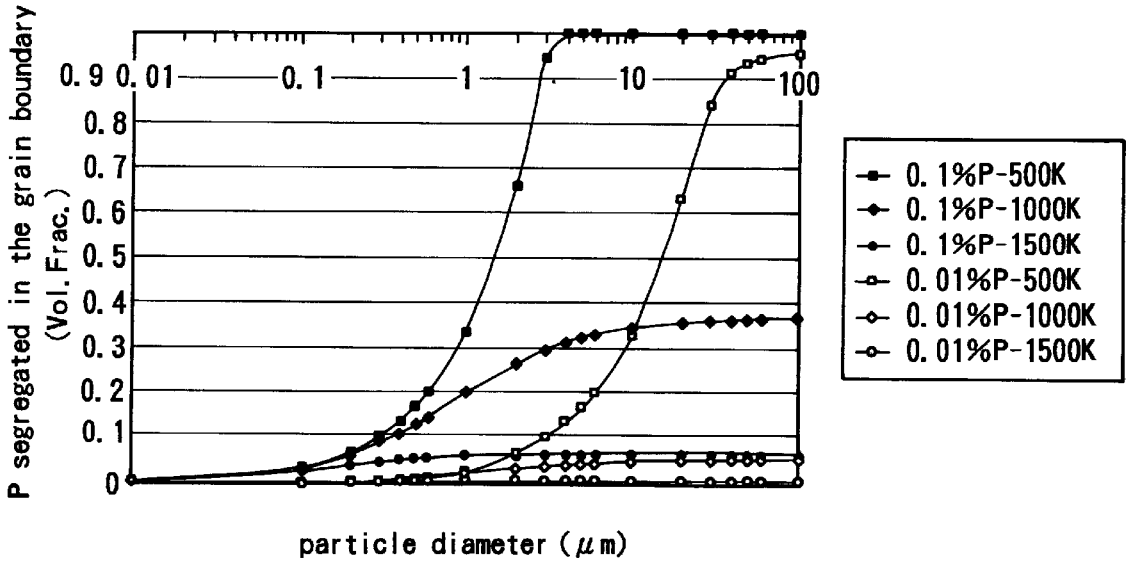
FIG. 1 is a diagram showing the change in volume of fractions of P segregated in the grain boundary with changing particle diameter for different P concentrations of 0.01% and 0.1% in the steel and for different temperatures, calculated in accordance with the McLean equation.

The volume fraction of P segregated in the grain boundary in accordance with <C> is related with the content of P <B> and the diameter of ferritic grains <A>, and the volume fraction of segregated P is calculated relative to the diameter of ferritic grains in accordance with the equation of McLean (D. McLean, "Grain Boundaries in Metals", Clarendon Press, Oxford (1957) 116). For instance, FIG. 1 shows the relation between the volume fraction of P segregated in the grain boundary and the grain diameter in accordance with the McLean equation for various temperatures (500 K, 1000 K, and 1500 K) and for the cases in which steel contains 0.01% P and 0.1% P, where the energy of segregating P in the grain boundary is taken as 53 kJ (H. Erhart and H. J. Grabke, Met. Sci., 15 (1981) 401). Based on the calculated results above, and from the viewpoint of preventing embrittlement due to the segregation of P in the grain boundary, in the case of a steel containing 0.1% P, the grain diameter is confined to a range of 3 μm or less so that the quantity of segregation in the grain boundary does not exceed 0.3 by volume fraction within a grain boundary thickness of 1 nm at 1000 K.

The segregation of P in the grain diameter in accordance with <C> is set at 0.3 or less by volume fraction in the present invention.

For the products falling outside the range of the requirements <A>, <B>, and <C> above, the presence of P functions as a negative factor which makes the high strength steel according to the present invention unfeasible.

For the carbon steel according to the present invention, the appropriate chemical composition is described above. By providing a steel having the composition in the aforementioned range, Ceq is confined in a level not exceeding the level for a 40-kg welding structural steel, thereby assuring a steel having good weldability.

Concerning a preferred method of production, the starting composition is molten, heated to a temperature of Ac3 point or higher for austenization, anvil compressing the resulting product to a draught of 50% or higher at a temperature of Ar3 point or higher, and cooling it thereafter.

The steel is worked at a temperature of Ar3 point or higher with an aim to attain a state consisting of only α phase and pearlite phase and to achieve an α phase at a state free of stresses such as dislocations. If the thermo-mechanical treatment should be performed at a temperature not higher than the defined range, residual stress would be accumulated in the α phase. The draught is set at 50% or higher to highly incorporate the working stress to provide a driving force of forming the nuclei for fine α grains which generate by the γ to α phase transformation. Sufficiently high driving force for finely reducing the grain size is not available if the draught is not higher than the defined range above.

The present invention is now described in further detail below by referring to Examples. However, the Examples are merely illustrative in nature and should not be construed to limit the spirit and scope of the claims.

EXAMPLE

The specimen for use in the example was prepared by adding 0.1% by mass of P to a base composition Fe—0.1C—0.3Si—1.5Mn (% by mass), and the resulting composition was molten at high frequencies and hot rolled. The results of chemical analysis are given in Table 1.

Thermo-mechanical treatment was then applied to the specimen obtained above by means of planar stress compression under the conditions of: transformation to γ phase by applying the working at 1173 K for a duration of 60 seconds; cooling at a rate of 10K/sec to 1023K; applying a nominal 75% compression stress at 1023 K; and cooling at a rate of 10 K/sec. The reduction of 75% corresponds substantially to 90% reduction at the central portion of the specimen.

The microstructure was observed by means of optical microscope and electron microscope.

Figure 2A:
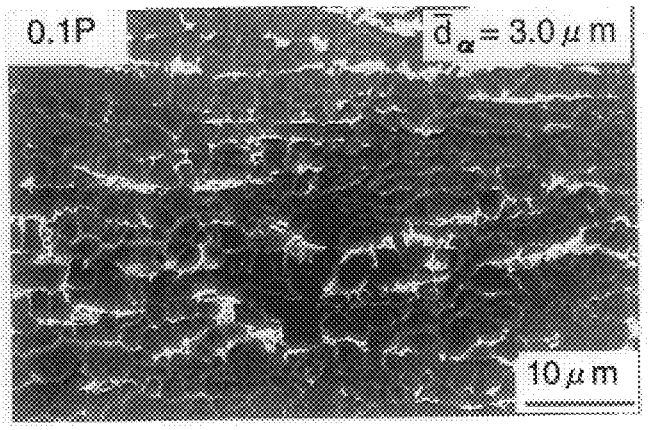
FIGS. 2A to 2C are each an electron micrograph showing the microstructure of a P-containing material according to the present invention (FIG. 2A) and comparative materials (FIGS. 2B and 2C) after subjecting each to thermo-mechanical treatment.

The results of microstructural observation of the specimen subjected to thermo-mechanical treatment are given in FIG. 2A. The mean grain diameter was found to be 3.0 μm for a specimen containing 0.1% P. The effect of 0.1% P addition on grain refinement can be clearly observed. The microstructure is found to be consisting mostly of equiaxed ferrite grains having a pearlite band. Then, by measuring the original specimen on the transformation by thermal expansion, it was found that the temperature of initiation for the γ to α transformation is shifted from 942 K to a lower temperature of 908 K by adding 0.1% P.

Figure 3:
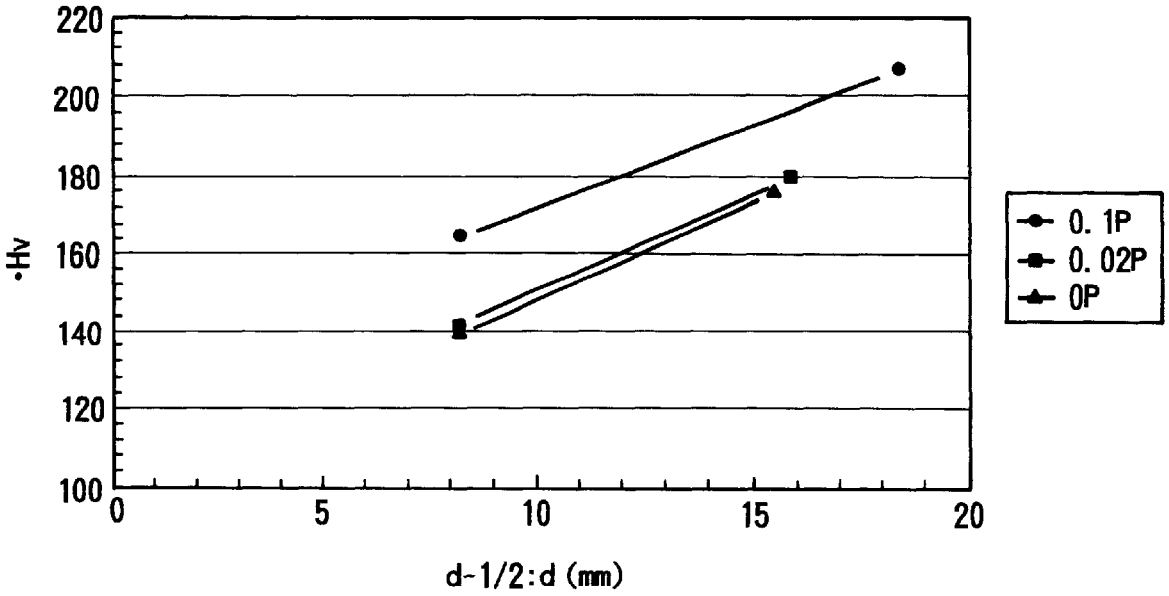
FIG. 3 is a diagram showing the Vickers' hardness of a P-containing material according to the present invention and comparative materials after hot rolling and thermo-mechanical treatment where 0.1 P is the material according to the present invention; and 0.02 P and 0 P are each comparative material 1 and comparative material 2, respectively.

FIG. 3 shows the Vickers' hardness values measured on the specimen subjected to thermo-mechanical treatment, which are plotted as a function of (−1/2) power of grain diameter. It can be seen therefrom that the hardness is increased with finely reducing the grain size. In FIG. 3, the plot at the upper right side corresponds to a specimen containing 0.1% P and having a mean grain diameter of 3 μm.

COMPARATIVE EXAMPLE

Figure 2B:
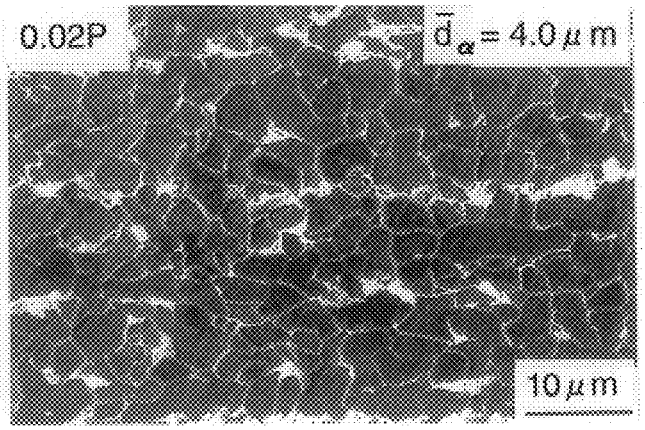
Figure 2C:
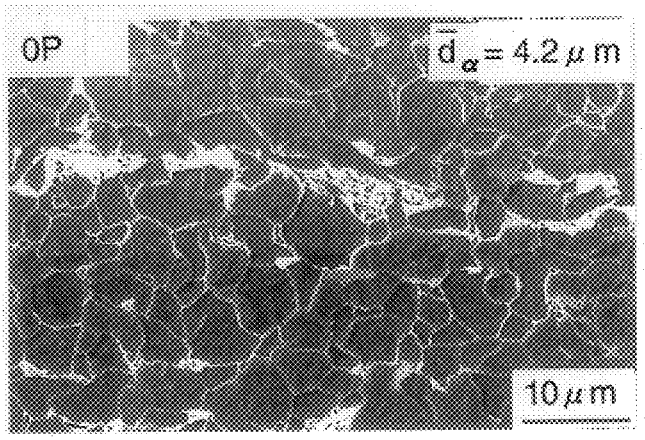

In FIGS. 2B and 2C are given the results of texture observation for two types of specimen corresponding to comparative examples subjected to thermo-mechanical treatment. Furthermore, the results of chemical analysis for the samples are given in Table 1. The mean diameter of the grains were 4.0 μm for the material added with 0.02% P (Comparative material 1) shown in FIG. 2B and 4.2 μm for the material added with 0% P (Comparative material 2) shown in FIG. 2C. Little effect on finely reducing the ferritic grains was observed in case of adding 0.02% P.

In FIG. 3 are given the Vickers' hardness values measured on the two types of comparative sample specimens subjected to thermo-mechanical treatment, which are plotted as a function of (−1/2) power of grain diameter together with a material of the present invention. It can be seen therefrom that the hardness increases with adding P. By extrapolating the results shown in FIG. 3, the hypothetical Hv values at a grain diameter of 3 μm can be obtained for the samples containing 0.02% P and 0% P. On comparing the values, it can be understood that the Hv value for a material having the same 3-μm grain size is considerably increased by adding 0.1% P (material of the present invention).

On calculating the volume fraction for P segregated in the grain boundary in accordance with McLean equation and in relation with the mean grain diameter of 4.0 μm for the case of a steel containing 0.02% P (Comparative material 1) at T=1000 K, a volume fraction of approximately 0.08 can be obtained.

TABLE 1

| Sample | Chemical composition | | | | | | | |
|---|---|---|---|---|---|---|---|---|
| | C | Si | Mn | P | S | Ti | T—Al | N |
| Invention | | | | | | | | |
| (target) | 0.1 | 0.3 | 1.5 | 0.1 | 0 | 0 | 0 | 0 |
| (found) | 0.074 | 0.29 | 1.45 | 0.098 | 0.001 | <0.01 | <0.01 | 0.002 |
| Comp. 1 | | | | | | | | |
| (target) | 0.1 | 0.3 | 1.5 | 0.02 | 0 | 0 | 0 | 0 |
| (found) | 0.098 | 0.29 | 1.48 | 0.022 | 0.001 | <0.01 | <0.01 | 0.0012 |
| Comp. 2 | | | | | | | | |
| (target) | 0.1 | 0.3 | 1.5 | 0 | 0 | 0 | 0 | 0 |
| (found) | 0.088 | 0.29 | 1.46 | <0.003 | 0.001 | <0.01 | <0.01 | 0.0016 |

As described in detail above, in contrast to the related art efforts for removing P in the smelting process, the present invention enables a high strength steel by positively utilizing P.

For instance, by adding about 0.1% by mass of P, the ductile/brittle transition temperature increases by 40 K, but the transition temperature greatly decreases with finely reducing the size of ferritic grains. Thus, the problem of embrittlement due to the presence of P can be overcome by finely reducing the size of crystal grains. Furthermore, the addition of P contributes to the fine reduction of ferritic grains.

Phosphorus is inexpensive, has excellent effect in reinforcing by forming solid solution, and yet, does not increase Ceq. In addition, if P is allowed to be present in the steel material, the smelting process can be simplified, leading to the development of ecologically favorable material.

Again, while the invention has ben described in detail with reference to examples, it should be understood that various changes and modifications can be made without departing from the spirit and the scope thereof.

What is claimed is:

1. A high strength phosphorus-containing steel having fine texture, which (a) is a carbon steel having an average ferritic grain diameter of 3 $\mu$m or less and comprising 0.04 to 0.1% by mass of P, wherein the volume fraction of P segregated in the grain boundary accounts for 0.3 or less in case the grain boundary is 1 nm in thickness and (b) has a structure consisting essentially of ferritic phase and pearlite phase.

2. The high strength phosphorus-containing steel as claimed in claim 1, which comprises a chemical composition in % by mass consisting essentially of 0.3% or less of C, 0.5% or less of Si, 3.0% or less of Mn, 0.02% or less of S, 0.04 to 0.1% of P and Fe with unavoidable impurities.

3. A method for producing the steel as claimed in claim 1, comprising heating the steel to a temperature of Ac3 point or higher for austenization, applying an anvil compression processing for a draught of 50% or higher at a temperature of Ar3 point or higher, and cooling said steel thereafter.

4. A method for producing the steel as claimed in claim 2, comprising heating the steel to a temperature of Ac3 point or higher for austenization, applying an anvil compression processing for a draught of 50% or higher at a temperature of Ar3 point or higher, and cooling said steel thereafter.

* * * * *